US005949013A

United States Patent [19]

Satoshi

[11] Patent Number: 5,949,013

[45] Date of Patent: Sep. 7, 1999

[54] KEYBOARD MUSICAL INSTRUMENT EQUIPPED WITH HAMMER STOPPER IMPLEMENTED BY PARALLELOGRAM LINK MECHANISM

[75] Inventor: Inoue Satoshi, Shizuoka, Japan

[73] Assignee: Yamaha Corporation, Hamamatsu, Japan

[21] Appl. No.: 08/925,854

[22] Filed: Sep. 9, 1997

[30] Foreign Application Priority Data

Sep. 18, 1996 [JP] Japan ..... 8-246634
Apr. 28, 1997 [JP] Japan ..... 9-111262

[51] Int. Cl.[6] ..... G10C 3/18; G10D 15/00; G10H 1/34

[52] U.S. Cl. ..... 84/719; 84/171; 84/236; 84/240

[58] Field of Search ..... 84/2, 3, 171, 236–255, 84/719, 720, 423 R, 423 A, 423 B, 424–441, DIG. 7

[56] References Cited

FOREIGN PATENT DOCUMENTS 8-123403 5/1996 Japan .

*Primary Examiner*—Stanley J. Witkowski
*Attorney, Agent, or Firm*—Graham & James LLP

[57] ABSTRACT

A keyboard musical instrument is a compromise between an upright piano and an electronic keyboard, and a hammer stopper is provided between hammer shanks and sets of strings; the hammer stopper has cushion members on a stopper rail where the hammer shanks rebound before a strike against the strings, and a pair of parallelogram crank mechanisms are connected to both end portions of the stopper rail so as to project the cushion members into and retract them from the trajectories of the hammer shanks, thereby decreasing space occupied by the cushion members.

12 Claims, 10 Drawing Sheets

KEYBOARD MUSICAL INSTRUMENT EQUIPPED WITH HAMMER STOPPER IMPLEMENTED BY PARALLELOGRAM LINK MECHANISM

FIELD OF THE INVENTION

This invention relates to a keyboard musical instrument and, more particularly, to a keyboard musical instrument equipped with a hammer stopper implemented by a parallelogram link mechanism.

DESCRIPTION OF THE RELATED ART

The keyboard musical instrument is a compromise between an acoustic piano and an electronic keyboard, and a hammer stopper and an electronic sound generating system are installed inside the acoustic piano. A player changes the hammer stopper between a free position and a blocking position, and plays a tune on the keyboard so as to generate acoustic sounds or electronic sounds depending upon the position of the hammer stopper. When the hammer stopper stays in the free position, depressed keys drive the associated hammers for rotation, and the hammers strike associated strings. The strings vibrate, and generate acoustic sound. On the other hand, when the hammer stopper is changed to the blocking position, the hammer rebounds on the hammer stopper before the strike at the strings, and the acoustic sound is never generated. However, a key sensor detects the motion of the depressed key, and a headphone generates an electronic sound from an audio signal produced on the basis of the key motion. Thus, the hammer stopper changes the sound source between the strings and the tone generator.

The hammer stopper is, by way of example, provided between the hammer shanks and the strings. However, the space between the hammer shanks and the strings is so narrow that the manufacturer hardly installs a large hammer stopper in the narrow space. A damper assembly also occupies the narrow space, and the hammer stopper is expected not to interfere with the motion of the damper assembly. Major component parts of the acoustic piano are made of wood, and require large margin for the assemblage. This means that the damper mechanism and the hammer stopper require large tolerances, and the large tolerances make the space further narrower. Thus, it is preferable to design the hammer stopper to be smaller.

As described hereinbefore, the hammer stopper is changed between the free position and the blocking position. Even if the hammer stopper occupies narrow space, the hammer stopper requires additional space during the motion between the free position and the blocking position. The hammer stopper may interfere with another component part such as the damper assembly during the motion. For this reason, it is preferable to design a driving mechanism to change the hammer stopper between the free position and the blocking position through small motion.

A typical example of the hammer stopper is disclosed in Japanese Patent Publication of Unexamined Application (JPA) No. 8-123403, and the prior art hammer stopper is changed between the free position and the blocking position through rotation over 90 degrees. Cushion members project from a shaft member, and are rotated together with the shaft member. When the hammer stopper enters into the blocking position, the cushion members are opposed to the hammer shank, and the hammer shank rebound on the cushion member. On the other hand, when the hammer stopper is changed to the free position, the cushion members turn over 90 degrees, and are shunted from the trajectory of the hammer shank. The prior art hammer stopper requires not only the space occupied at both of the free and blocking positions but also the space along the trajectory of the cushion members. Thus, the prior art hammer stopper requires the wide space.

Another prior art hammer stopper is directly connected to a wire, and a player pulls the wire for changing the prior art hammer stopper. The prior art hammer stopper is advanced toward the hammer shank at the home position, and is spaced therefrom. Thus, the wire moves the hammer stopper in the direction substantially identical with the direction of the turning motion of the hammer shank. In this instance, the manufacturer is expected to pass the wire through the complicated key action mechanism. Even if the manufacturer succeeds in the hard work, the terminal end portion of the wire connected to the hammer stopper is not always matched with the direction of the motion of the hammer stopper. In this situation, when the player pulls the wire, the force is not effectively transferred to the hammer stopper. In order to smoothly move the hammer stopper in spite of the in consistency in direction between the motion of the hammer stopper and the motion of the wire, a suitable guide member is required for the hammer stopper. This results in increase of the component parts of the hammer stopper. It is desirable for the hammer stopper to decrease the component parts so as to reduce the production cost.

SUMMARY OF THE INVENTION

It is therefore an important object of the present invention to provide a hammer stopper which is free from interference with another component part without increase of components parts.

To accomplish the object, the present invention proposes to use a parallelogram crank mechanism for changing a movable stopper between a free position and a blocking position.

In accordance with one aspect of the present invention, there is provided a keyboard musical instrument comprising an acoustic piano including a keyboard having a plurality of keys turnable with respect to a stationary board member, a plurality of string means vibratory for generating acoustic sounds, and a plurality of key action mechanisms respectively linked with the plurality of keys and having respective hammers each driven for rotation along a trajectory so as to strike associated one of the plurality of string means when associated one of the plurality of keys is depressed, an electronic sound generating system monitoring the plurality of keys and generating an electronic sounds when one of the plurality of keys is depressed, and a silent mechanism including a movable stopper changed between a free position and a blocking position, the movable stopper in the free position being out of the trajectory of each of the hammers so as to allow the aforesaid each of the hammers to strike associated one of the plurality of string means, the movable stopper in the blocking position being positioned in the trajectory of the aforesaid each of the hammers so as to interrupt the aforesaid each of the hammers before a strike against associated one of the plurality of string means, a stationary member stationary with respect to the stationary board member, two link members having respective first ends turnably connected to the movable stopper and respective second ends turnably connected to the stationary member so as to form a parallelogram crank mechanism together with the stationary member and the movable stopper, and a driving means connected to at least one of the two link members and the movable stopper and changing an angular position of the two link members so as to change the movable stopper between the free position and the blocking position.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENT

Structure of Keyboard Musical Instrument

Figure 1:
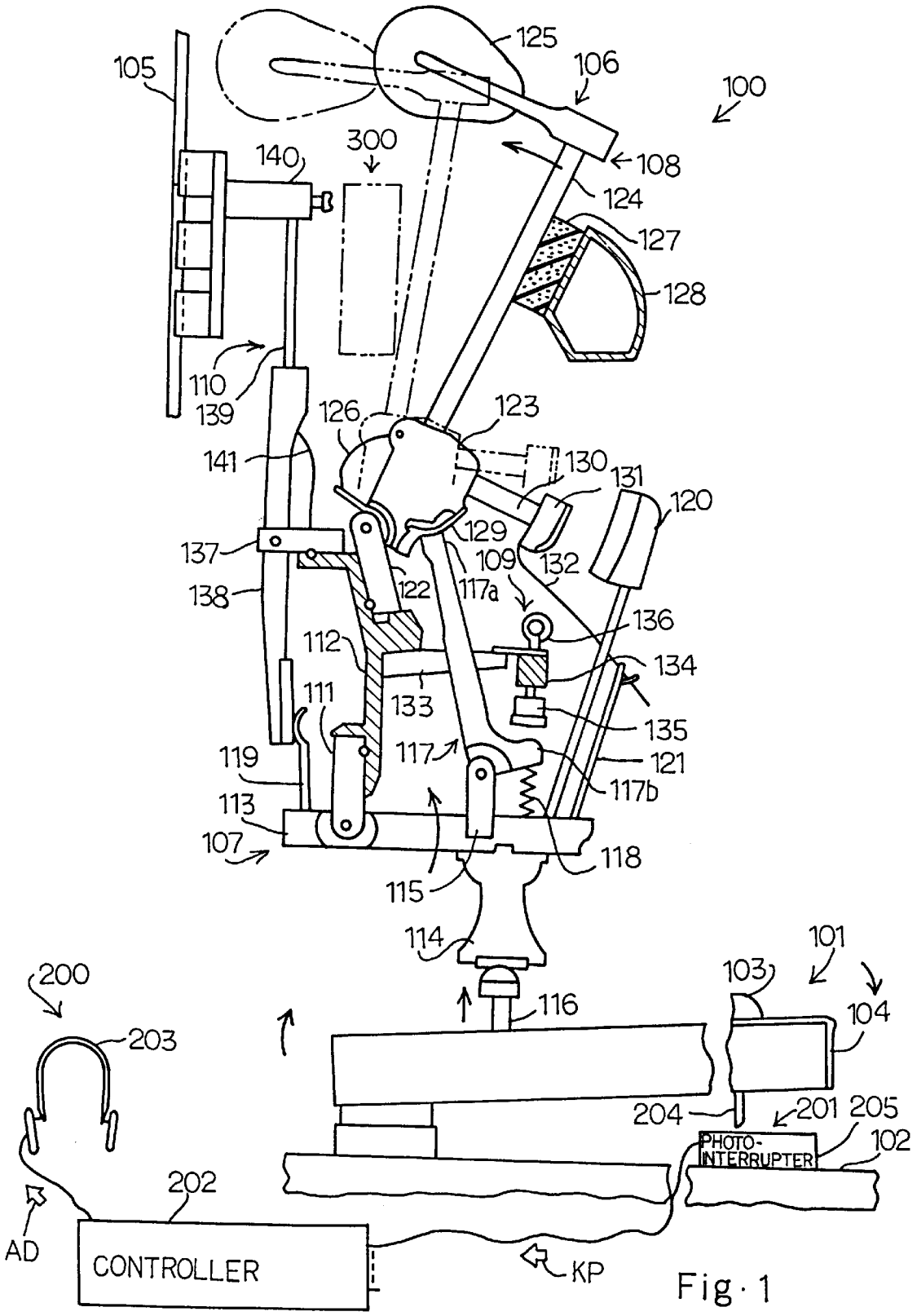
FIG. 1 is a side view showing essential parts of a keyboard musical instrument according to the present invention.

FIG. 1 illustrates the structure of a keyboard musical instrument embodying the present invention. The keyboard musical instrument largely comprises an acoustic piano 100, an electronic sound generating system 200 and a silent mechanism 300. In the following description, term "front" means a position closer to a pianist sitting in front of the upright piano 100 than "rear" position, and a direction between a front position and a rear position is referred to as "longitudinal direction". Term "lateral" indicates the perpendicular direction to the longitudinal direction.

The acoustic piano is a standard upright piano, and includes a keyboard 101 mounted on a key bed 102. The keyboard 101 consists of a plurality of black keys 103 and a plurality of white keys 104, and the black/white keys 103/104 are arranged in the lateral direction. Notes of the scale are respectively assigned to the black/white keys 103/104, and a player specifies a tone by depressing one of the black/white keys 103/104.

The black/white keys 103/104 are turnable with respect to a balance rail (not shown) between respective rest positions and respective end positions. When a player does not exert force on the black/white key 103/104, the black/white key 103/104 is staying in the rest position. When the player depresses the black/white key 103/104, the black/white key 103/104 turns from the rest position toward the end position. However, if the player releases the black/white key 103/104, the black/white key 103/104 returns to the rest position.

The acoustic piano 100 further includes sets of strings 105 corresponding to the black/white keys. The sets of strings 105 are vibratory, and respectively generate acoustic sounds having the notes.

The acoustic piano 100 further comprises a plurality of key action mechanisms 106 respectively linked with the black/white keys 103/104. The key action mechanism 106 is actuated by the associated black/white key 103/104 so as to strike the associated set of strings 105, and is broken down into a whippen assembly 107, a hammer assembly 108, a regulating mechanism 109 and a damper assembly 110.

The whippen assembly 107 includes a whippen flange 111 fixed to a center rail 112, a whippen 113 turnably connected at one end thereof to the whippen flange 111, a whippen heel 114 downwardly projecting from the lower surface of the whippen 113 and a jack flange 115 upright from the other end portion ofthe whippen 113. A capstan button 116 projects from the rear end portion ofthe associated black/white key 103/104, and is held in contact with the whippen heel 114. While the associated black/white key 103/104 is turning from the rest position toward the end position, the capstan button 116 upwardly pushes the whippen heel 114, and the whippen 113 turns around the whippen flange 111 in the counter clockwise direction.

The whippen assembly 107 further includes a jack 117 turnably supported by the jack flange 115, a jack spring 118 urging the jack 17 to turn in the counter clockwise direction, a damper spoon 119 upright from one end portion of the whippen 113, a back check 120 upright from the other end portion of the whippen 113 and a bridle wire 121 also upright from the other end portion of the whippen 113. The damper spoon 119 is described in conjunction with the damper assembly 110, and the back check 120 and the bridle wire 121 cooperate with the hammer assembly 108 as will be described hereinlater.

The hammer assembly 108 includes a butt flange 122 fixed to the center rail 112, a hammer butt 123 turnably connected to the butt flange 122, a hammer shank 124 projecting from the hammer butt 123, a hammer head 125 fixed to the leading end of the hammer shank 124 and a butt spring 126 urging the hammer butt 123 in the clockwise direction so as to hold the hammer shank 124 in contact with a hammer rail cloth 127 attached to a hammer rail 128. The position where the hammer shanks 124 are held in contact with the hammer rail cloth 127 is hereinbelow referred to as "home position".

The hammer assembly 108 further includes a butt skin 129 bonded to a lower surface of the hammer butt 123, and a leading end portion 117*a* of the jack 117 kicks the butt skin 129 so as to drive the hammer butt 123 for rotation in the counter clockwise direction around the butt flange 122.

The hammer assembly 108 further includes a catcher shank 130 projecting from the hammer butt 123 and a catcher 131 attached to the leading end of the catcher shank 130. The catcher shank 130 is spaced from the hammer shank 124 at 90 degrees, and the catcher 131 is opposed to the back check 120. The catcher 131 is connected through a bridle tape 132 to the bridle wire 121. The bridle tape 132 links the returning motion of the hammer assembly 108 with the returning motion of the whippen assembly 107, and prevents the set of strings 105 from double strike. The back check 120 receives the catcher 131 during the rotation after the rebound.

While the associated black/white key 103/104 is staying in the rest position, the capstan button 116 horizontally maintains the whippen 113, the hammer shank 124 is resting on the damper rail cloth 127, and the jack 117 is held in contact with the butt skin 129 as indicated by the real lines in FIG. 1. The pianist is assumed to depress the associated black/white key 103/104. The associated black/white key 103/104 is turning from the rest position toward the end position. The capstan button 116 upwardly pushes the whippen heel 114, and the jack 117 turns around the whippen flange 111 together with the whippen 113. The jack 117 pushes the hammer butt 123, and the hammer shank 124 and the hammer head 125 turn around the butt flange 122 together with the hammer butt 123. When the associated black/white key 103/104 reaches a certain point between the rest position and the end position, the jack 117 kicks the butt skin 129, and the hammer butt 123 escapes from the jack 117 so as to start the free rotation toward the set of strings 105.

The regulating mechanism 109 determines the certain point. The regulating mechanism 109 includes regulating brackets 133 fixed to the center rail 112, a regulating rail 134 supported by the regulating brackets 133, regulating buttons 135 opposed to the tows 117*b* of the jacks 117 and regulating screws 136 connecting the regulating buttons 135 to the regulating rail 134. When the tow 117*b* is brought into contact with the regulating button 135 during the rotation together with the whippen 113, the reaction causes the jack 117 to quickly turn around the jack flange 115, and the jack 117 kicks the butt skin 129. Thus, the tow 117*b* is advanced toward the regulating button 135, and the jack 117 kicks the butt skin 129 upon contact with the regulating button. If a player wants to make the certain point earlier, the player rotates the regulating screw 136 so as to decrease the gap.

The damper assembly 110 includes a damper flange 137 fixed to the center rail 112, a damper lever 138 rotatably supported by the damper flange 137, a damper wire 139 projecting from the damper lever 138, a damper head 140 fixed to the leading end of the damper wire 139 and a damper spring 141 urging the damper lever 138 in the counter clockwise direction so as to hold the lower end portion in contact with the damper spoon 119. While the whippen 113 is turning in the counter clockwise direction, the damper spoon 119 declines, and pushes the damper lever 138. The damper lever 138 is rotated in the clockwise direction against the damper spring 141, and the damper head 140 is spaced from the set of strings 105. On the contrary, the whippen 113 turns in the clockwise direction upon release of the black/white key 103/104, and the damper spring 141 urges the damper lever 138 to turn in the counter clockwise direction. As a result, the damper head 140 is brought into contact with the set of strings 105, again.

While the black/white key 103/104 is turning from the rest position to the end position, the damper spoon 119 firstly spaces the damper head from the set of strings 105, and, thereafter, the jack 117 and the regulating button 135 allow the hammer assembly 110 to escape from the set of strings 105. The hammer head 125 strikes the set of strings 105, and rebounds thereon. After the release of the depressed black/white key 103/104, the damper head 140 is brought into contact with the set of strings 105, and takes up the vibrations.

The electronic sound generating system 200 includes a plurality of key sensors 201, a controller 202 and a headphone 203. The key sensors 201 respectively monitor the black/white keys 103/104, and produce key position signals KP. The key position signal KP is representative of the motion of the associated black/white key 103/104, and is supplied to the controller 202.

In this instance, the key sensor 201 is implemented by a shutter plate 204 and a photo-interrupter 205. The shutter plate 204 is attached to the lower surface of the associated black/white key 103/104, and interrupts optical beams of the photo-interrupter 205. The photo-interrupter 205 changes the key position signal KP depending upon the photo-interruption of the shutter plate 204. The controller 202 determines the current key position on the trajectory between the rest position and the end position on the basis of the key position signal KP.

The controller 202 instructs a tone generator (not shown) incorporated therein to produce an audio signal AD at a certain point on the trajectory, and the headphone 203 produces an electronic sound from the audio signal AD with the note assigned the depressed black/white key 103/104. On the other hand, while the depressed black/white key 103/104 is released, the controller 202 instructs the tone generator to stop the generation of the audio signal at another certain point on the trajectory, and the electronic signal is extinguished.

Figure 2:
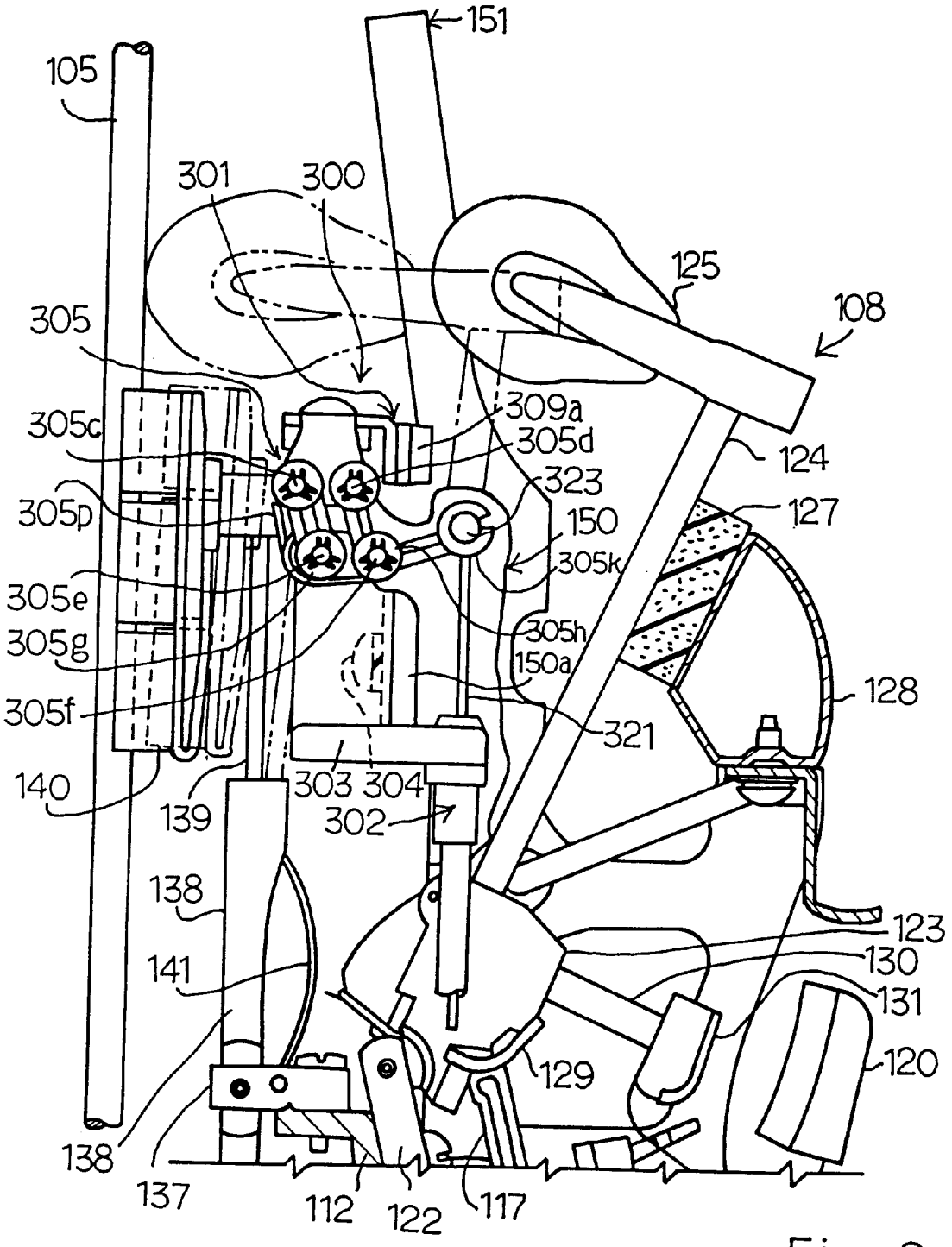
FIG. 2 is a side view showing a silent mechanism incorporated in the keyboard musical instrument.

The silent mechanism 300 is provided in a space between the hammer assemblies 108 and the sets of strings 105, and is detailed in FIG. 2. The silent mechanism 300 changes the keyboard musical instrument between an acoustic sound mode and an electronic sound mode. The keyboard musical instrument in the acoustic sound mode generates the acoustic sounds through the vibrations of the sets of strings 105, and the silent mechanism 300 stops the generation of the acoustic sounds in the electronic sound mode. However, the electronic sound generating system 200 generates the electronic sounds, and the pianism hears the electronic sounds produced by the headphone 203.

The silent mechanism 300 largely comprises a hammer stopper 301 and a change-over mechanism 302, and the hammer stopper 301 is provided in the space between the sets of strings 105 and the hammer shanks 124 at the home position. Reference numerals 150 and 151 designate action brackets respectively provided on both sides of the array of the hammer assemblies 108. However, the action bracket 150 on the left side is partially cut away.

Figure 3:
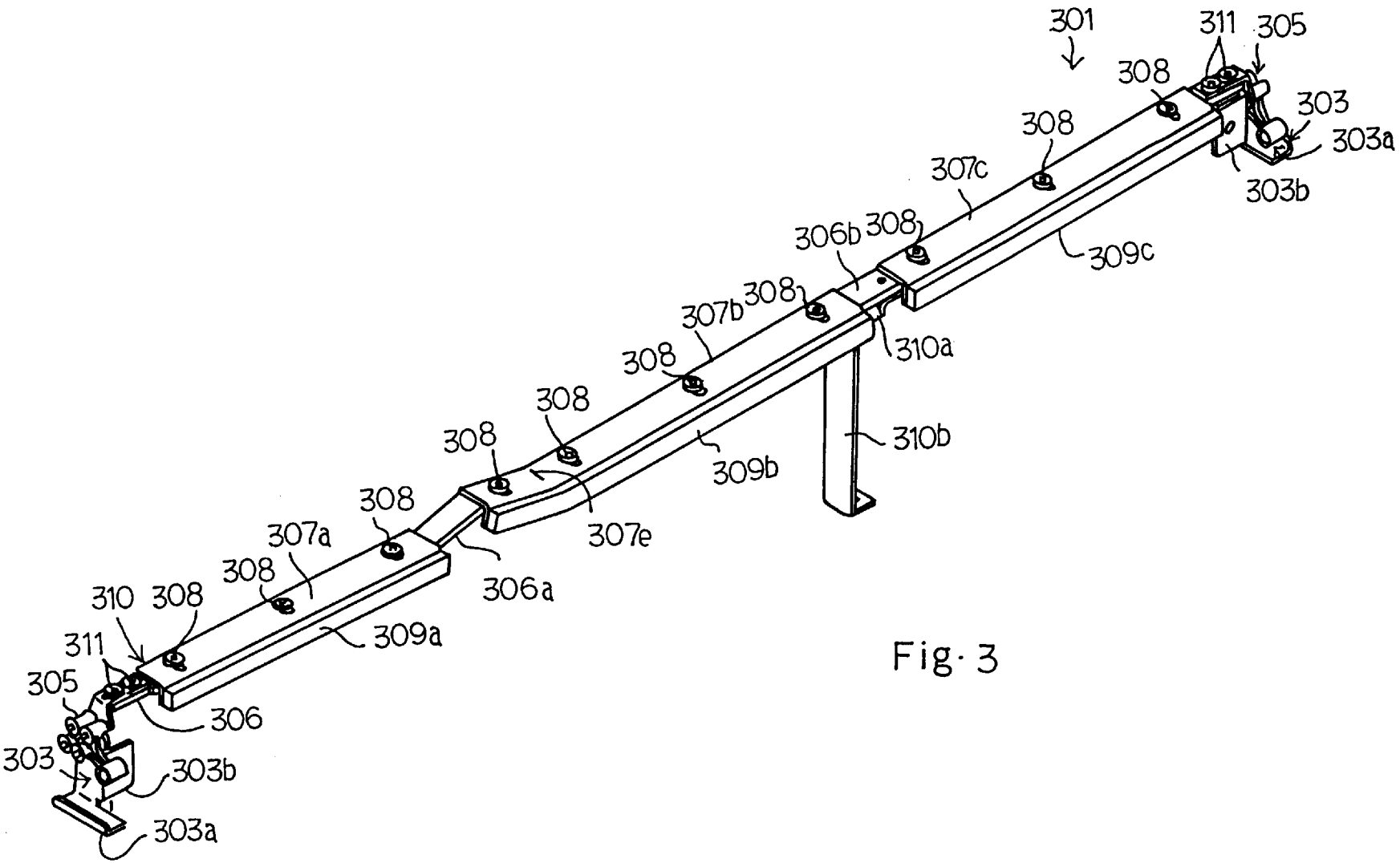
FIG. 3 is a perspective view showing the structure of a hammer stopper incorporated in the keyboard musical instrument.
Figure 5:
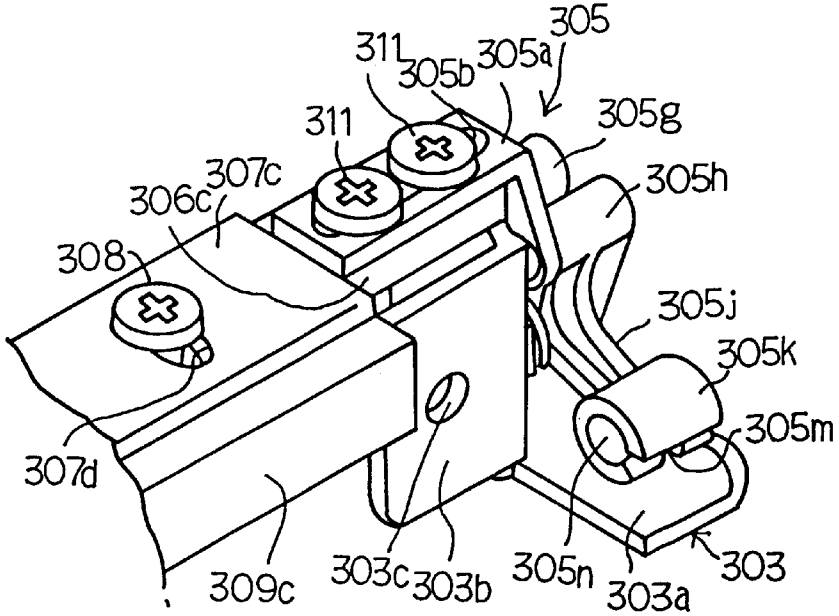
FIG. 5 is a perspective view showing the right end portion of the hammer stopper.
Figure 4:
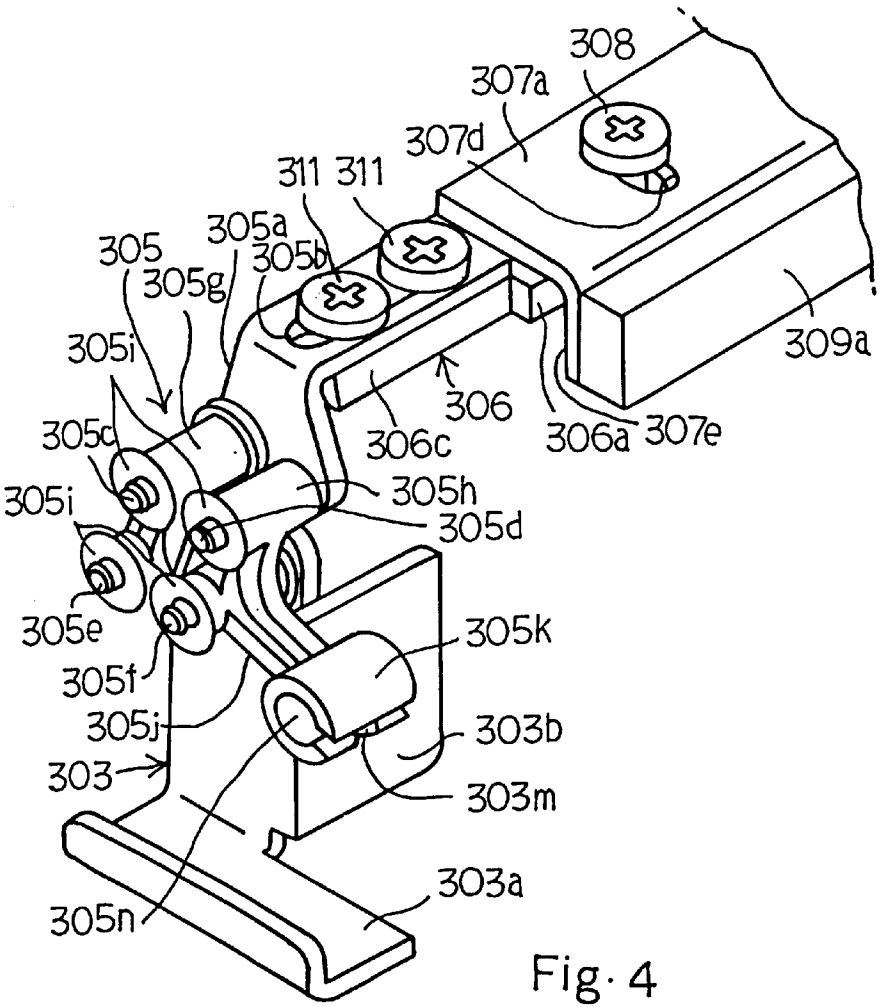
FIG. 4 is a perspective view showing the left end portion of the hammer stopper.

The hammer stopper 301 is illustrated in detail in FIG. 3, and both end portions of the hammer stopper 301 are enlarged in FIGS. 4 and 5. The hammer stopper 301 includes a pair of supporting brackets 303, and the supporting brackets 303 are attached to the action brackets 150, respectively. In detail, each of the supporting brackets 303 has a horizontal portion 303*a* and vertical wall portion 303*b* upright from the horizontal portion 303*a*. The vertical wall portion 303*b* is curved at 90 degrees, and a threaded through-hole 303*c* is formed in the vertical wall portion 303*b*. Each of the action brackets 150/151 has a vertical portion 150*a*, and a threaded through-hole is also formed in the vertical portion 150*a*. The threaded through-hole 303*c* is aligned with the threaded through-hole formed in the vertical portion 150*a*, and a bolt 304 is screwed into the threaded through-holes so as to fix the supporting bracket 303 to the action bracket 150/151.

The hammer stopper 301 further includes three coupling units 305, a stopper rail 306, a plurality of brackets 307*a*/307*b*/307*c* fixed to the stopper rail 306 by means of bolts 308 and a plurality of cushion members 309*a*/309*b*/309*c* attached to the brackets 307*a*/307*b*/307*c*, respectively. The coupling units 305 are provided on both ends of the stopper rail 306 and an intermediate portion. In this instance, the cushion members 309*a*/309*b*/309*c* are formed of urethane foam. However, other shock absorbing material such as felt covered with artificial leather is available for the cushion members 309*a*/309*b*/309*c*. The stopper rail 306, the brackets 307*a*/307*b*/307*c* and the cushion members 309*a*/309*b*/309*c* as a whole constitute a movable stopper 310.

The black/white keys 103/104 are divided into three groups, i.e., the first key group for low-pitched tones, the second key group for middle-pitched tones and the third key group for high-pitched tones, and the cushion members 309*a*/309*b*/309*c* are provided for the hammer assemblies 108 associated with the first key group, the hammer assemblies 108 associated with the second key group and the hammer assemblies 108 for the third key group. Through-holes 307*d* are formed in the brackets 307*a*/307*b*/307*c*, and are elongated in the longitudinal direction. For this reason, the manufacturer can vary the gap between the front surface 306*a* of the stopper rail 306 and the rear surfaces 307*e* of the brackets 307*a*/307*b*/ 307*c*, and the cushion members 309*a*/ 309*b*/ 309*d* are independently adjusted to respective appropriate positions for blocking the strings 105 from the hammer heads 125 after the escape from the jacks 117. Accordingly, the cushion members 309*a*/309*b*/309*c* are not expected to be equal in thickness.

In the upright piano, the strings 105 for the low-pitched tones cross the strings 105 for the middle-pitched tones and the high-pitched tones, and the hammer heads 125 and the damper heads 140 for some strings 105 closer to the low pitched tones are higher than those for the other strings. For this reason, the stopper rail 306 is substantially straight from the right portion to a middle portion, and is upwardly bent at a certain point 307*e* in the middle portion. Accordingly, the bracket 307*b* and the cushion member 309*b* are bent so as to be matched with the stopper rail 306. The stopper rail 306 is downwardly bend from the middle portion to the left portion, and an oblique portion 306*a* connects the middle portion to the left portion so that the bracket 307*a* is lower than the other brackets 307*b*/ 307*c*. Thus, the stopper rail 306 regulates the cushion members 309*a*/309*b*/309*c* to appropriate height so that the movable stopper 310 allows the hammer shanks 124 to appropriately rebound thereon without an interference with the damper assemblies 110 and the hammer heads 125.

A bracket 310*a* is attached to the lower surface of a connecting portion 306*b* between the right portion and the middle portion of the stopper rail 306, and a center stay 310*b* is provided between the center rail 112 and the bracket 310*a*. One of the coupling units 305 is provided between the bracket 310*a* and the center stay 310*b*. The center stay 310*b* supports the load of the movable stopper 310, and prevents the movable stopper 310 from undesirable deformation.

The stopper rail 306 is connected at both end portions thereto to the coupling units 305 by means of bolts 311, and the coupling units 305 are supported by the supporting brackets 303.

The coupling unit 305 includes a bracket 305*a* attached to an end portion 306*fc* of the stopper rail 306, and the bracket 305*a* has a horizontal portion and a vertical portion. A through-hole 305*b* is formed in the horizontal portion of the bracket 305*a*, and is elongated in the lateral direction. The bolts 311 are screwed through the through-hole 305*b* into the end portion 306*c*, and the manufacturer can regulate the position of the cushion members 309*a*/309*b*/309*c* by changing the length overlapped between the end portions 306*c* and the brackets 305*a*.

The coupling unit 305 further includes pins 305*c*/305*d* implanted into the vertical portion of the bracket 305*a*, pin members 305*e*/305*f* implanted into the vertical portion of the supporting bracket 303 and link members 305*g*/305*h* rotatably engaged with the pins 305*c*/305*d* and 305*e*/305*f*. The pins 305*c*/305*d* are spaced from each other in the longitudinal direction, and the pins 305*e*/305*f* are also spaced from each other in the longitudinal direction. The pins 305*c*/305*d* are slightly deviated from the pins 305*e*/305*f*, and the pins 305*c*/305*d*/305*e*/305*f* are located at the four corners of a parallelogram as will be seen in FIG. 2.

The link members 305*g* has an upper bobbin, a lower bobbin and a connecting plate between the upper bobbin and the lower bobbin, and the pin 305*c* and the pin 305*e* are inserted into the hole formed in the upper bobbin and the hole formed in the lower bobbin, respectively. Clamp rings 305*i* are engaged with the pins 305*c*/305*d*, and the upper and lower bobbins of the link member 305*g* are rotatable around the pins 305*c* and 305*e*, respectively.

The link member 305*h* also has an upper bobbin, a lower bobbin, a connecting plate 305*j* between the upper bobbin and the lower bobbin and a journal 305*k* attached to the leading end of the connecting plate 305*j*, and the connecting plate is curved so that the journal 305*k* projects from the vertical portion 303*b* of the supporting bracket 303. The journal 305*k* has C-letter like cross section, and a slit 305*m* is open to the cylindrical inner space 305*n*. The clamp rings 305*i* are also engaged with the pins 305*d* and 305*f*, and the upper bobbin and the lower bobbin are rotatable around the pins 305*d*/305*f*, respectively. Thus, the link members 305*g*/ 305*h*, the supporting block 303 and the bracket 305*a* form a parallelogram crank mechanism, and the movable stopper 310 turns around the pin members 305*e*/305*f*.

The coupling unit 305 further includes a torsion coil spring 305*p*. The torsion coil spring 305*p* has a first arm engaged with the upper bobbin of the link member 305*g* and a second arm engaged with the lower bobbin of the link member 305*h*, and urges the link members 305*g*/305*h* so that virtual line between the pins 305*c* and 305*e* makes a certain angle with virtual line between the pins 305*e* and 305*f*.

The coupling unit between the bracket 310*a* and the center stay 310*b* is similar in arrangement to the coupling units 305 on both sides of the movable stopper 310. The coupling unit at the intermediate portion of the movable stopper 310 also has the bracket 305*a* attached to the bracket 310*a*, and the pins 305*e*/305*f* are fixed to the center stay 310*b*.

Figure 6:
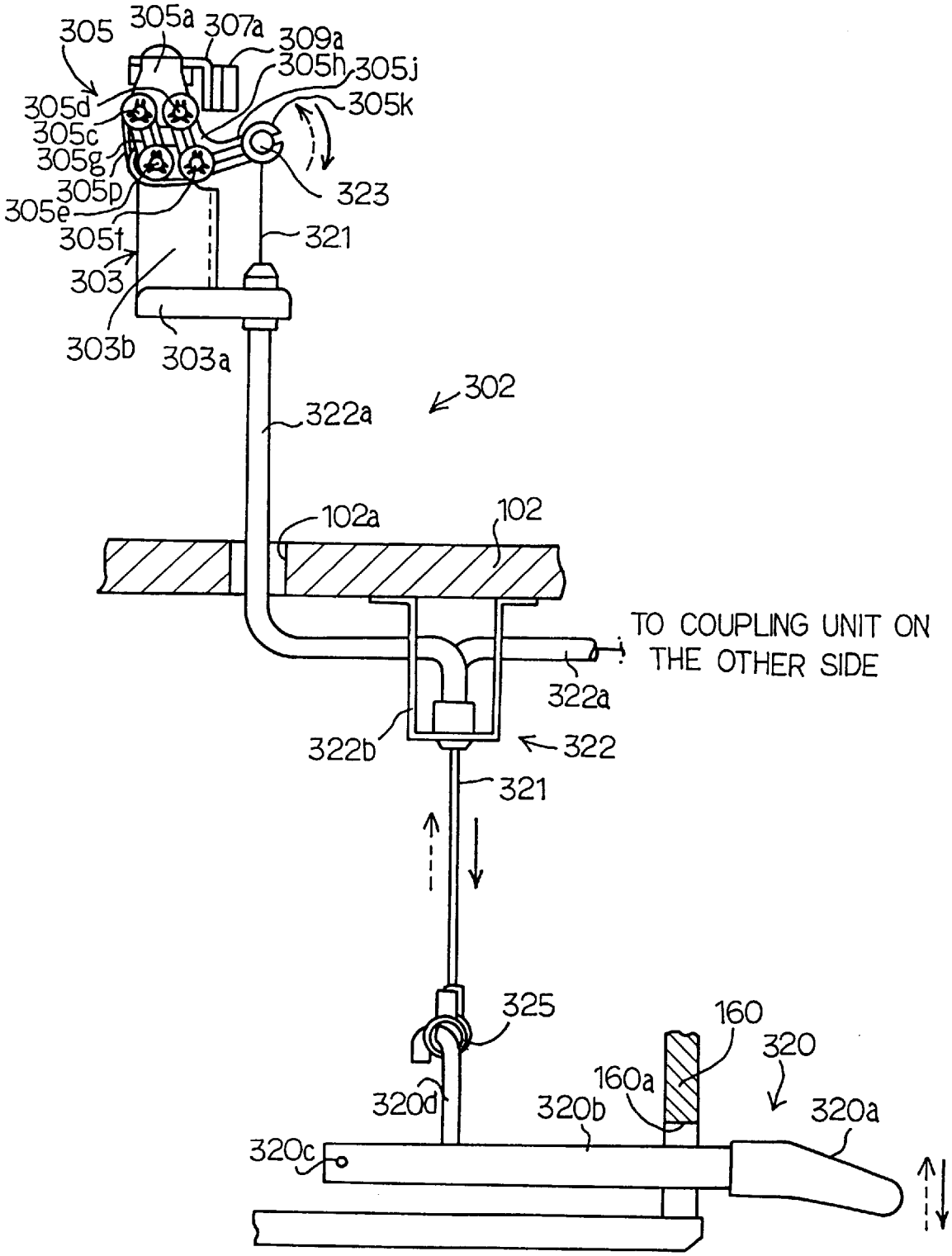
FIG. 6 is a side view showing a change-over mechanism connected to the hammer stopper.

The change-over mechanism 302 is illustrated in FIG. 6 in detail, and a pianist changes the movable stopper 310 between the free position and the blocking position by means of the change-over mechanism 302.

The change-over mechanism 302 largely comprises a pedal sub-mechanism 320, a pair of flexible wires 321 and a glide structure 322. A cylindrical pin member 323 is connected to the leading end of the flexible wire 321, and is inserted into the inner cylindrical space 305*n*. For this reason, the cylindrical pin member 323 is rotatable with respect to the journal 305*k*, and the flexible wire 321 exerts pulling force on the journal 305*k* without disconnection from the journal 305*k*. The leadings end portion of the flexible wire 321 passes through the slit 305*m*, and downwardly extends from the cylindrical pin member 323. The flexible wire 321 passes through the key bed 102, and is terminated at a coil member 325.

The pedal sub-mechanism 320 includes a foot pedal 320*a* projecting through a slit 160*a* formed in a bottom sill 160 ofthe acoustic piano 100 and a connecting member turnable around a pin 320*c* and a hook 320*d* upright from the connecting member 320*b*. The foot pedal 320*a* is fixed to the leading end of the connecting member 320*b*, and the hook 320*d* is engaged with the coil member 325. Though not shown in FIG. 6, the pedal sub-mechanism 320 is associated with a ratchet mechanism, and the ratchet mechanism maintains the foot pedal 320*a* at the depressed position. When the pianism further depresses the foot pedal 320*a*, the ratchet mechanism is released, and torsion coil member 305*p* allows the foot pedal 320*a* to return to the rest position.

The guide structure 322 includes flexible sheathes 322*a* and a bracket 322*b* attached to the lower surface of the key bed 102. The flexible wires 321 are guided by the flexible sheathes 322*a* to the coupling units 305 at both sides of the movable stopper 310, and the coil members 325 of both flexible wires 321 are engaged with the hook 320*d*. However, the pedal sub-mechanism 320 is not linked with the coupling unit between the bracket 310*a* and the center stay 310*b*.

Each of the flexible sheaths 322*a* is fixed at one end thereof to the horizontal portion 303*a* of the supporting bracket 303 and at the other end thereto to the bracket 322*b*. The flexible sheath 322*a* passes through a through-hole 102*a* formed in the key bed 102, and is twice bent so that the flexible wire 321 is vertically connected to the cylindrical pin member 323 and the coil member 325 at both end thereof When a pianist presses down the pedal 320*a*, the flexible wire 321 effectively transfers the force to the coupling unit 305, and causes the movable stopper 310 to turn between the free position and the blocking position.

The silent mechanism 300 is simple, and the manufacturer easily installs the silent mechanism 300 in the upright piano 100. The movable stopper 310 is advanced toward the hammer shanks 124 at the home position, and is spaced from the hammer shanks 124 at the home position. Therefore, the trajectory of the movable stopper 310 is matched with the trajectory of the hammer shanks 124, and the movable stopper 124 occupies additional space only when the movable stopper 124 is staying at the free position. Thus, the movable stopper 310 requires extremely narrow space, and does not interfere with other component parts such as damper assembly 110.

Figure 7:
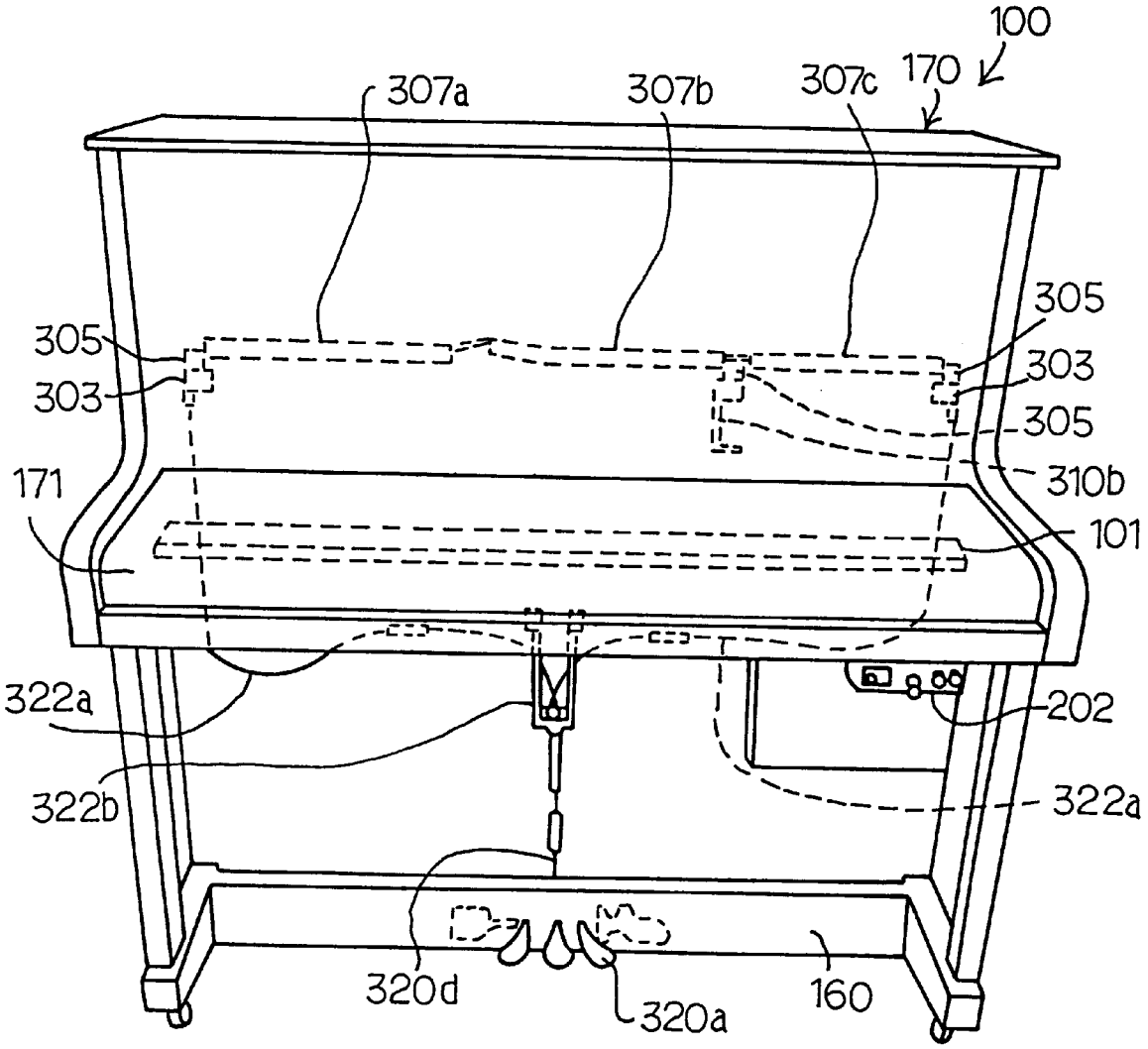
FIG. 7 is a front view showing a keyboard musical instrument equipped with the hammer stopper shown in FIG. 3.

FIG. 7 illustrates the silent mechanism 300 installed inside a piano case 170 of the acoustic piano 100. The keyboard 101 is covered with a fall board 171. Though not shown in FIG. 7, the key action mechanisms 106 and the sets of strings 105 are installed inside the piano case 170, and the hammer stopper 301 is provided in the lateral direction. The pair of parallelogram crank mechanisms on both sides of the hammer stopper 301 is connected through the flexible wires 321 to the pedal 320*a*.

Figure 8:
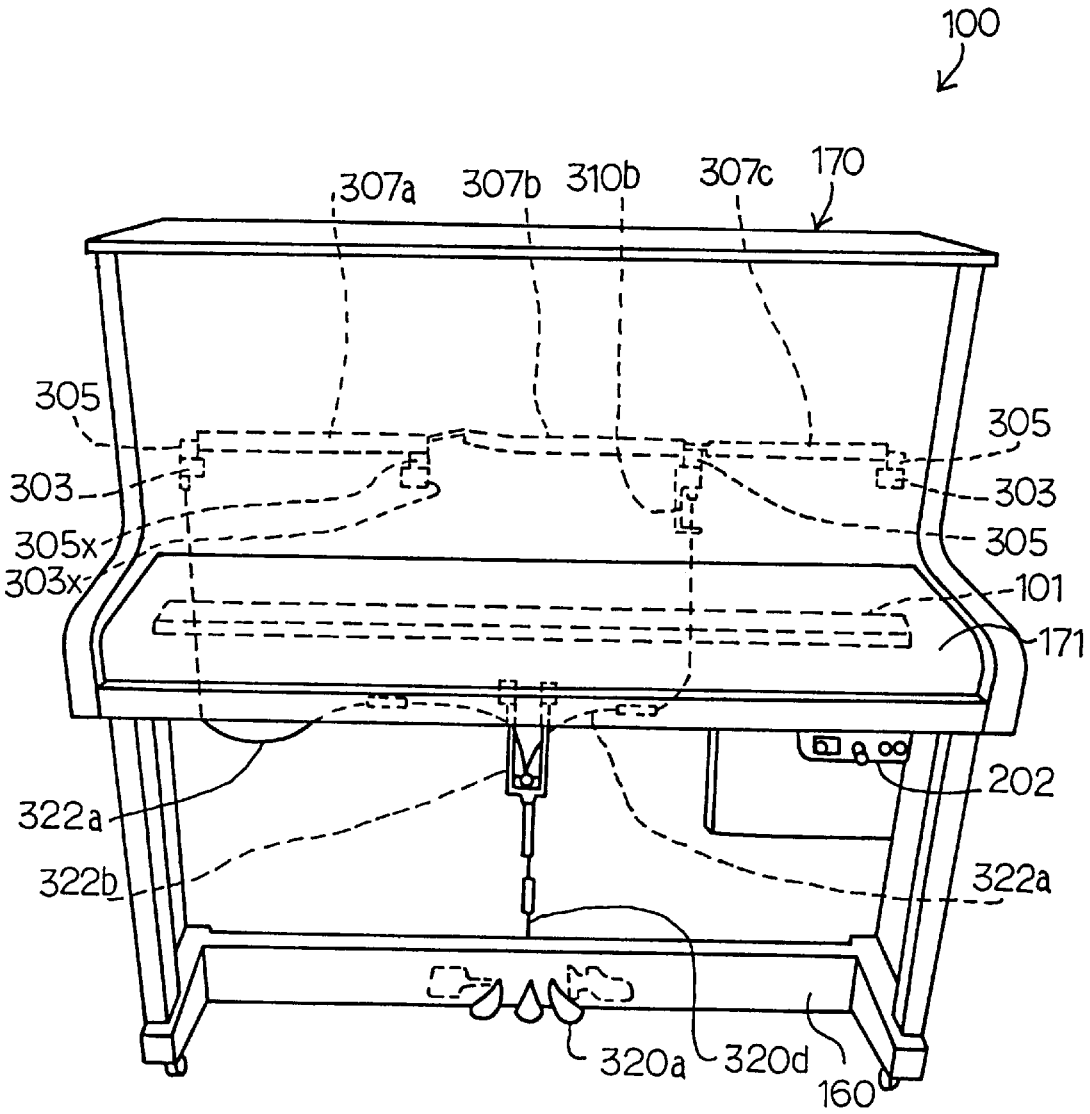
FIG. 8 is a front view showing another keyboard musical instrument according to the present invention.

The change-over mechanism 302 may be connected to the coupling unit 305 at one end of the movable stopper 310 and the coupling unit 305 at the intermediate point as shown in FIG. 8. In this instance, the span between the coupling units 305 to be driven is short, and the movable stopper 310 is lightly rotated. Moreover, one more supporting member 303*x* is provided between the center stay 310*b* and the supporting member 303 on the left side of the movable stopper 310, and the supporting member 303*x* is connected through another coupling unit 305*x* to the movable stopper 310. The coupling unit 305*x* makes the movable stopper 310 smoothly turn between the free position and the blocking position.

Though not shown in FIG. 8, a plate of cast iron vertically extends inside the piano case 170, and is reinforced by four ribs. The rein forcing ribs project from the front surface of the plate, and also vertically extend at intervals. The rear end portions ofthe black/white keys 103/104 are placed between the reinforcing ribs, and gaps take place between the reinforcing rib and the rear end portions of the black/white keys 103/104. The bracket 310*a* (see FIG. 3) is provided over a wider gap between the second reinforcing rib from the right side and the rear end portion of the black/white key 103/104, and the wire 321 downwardly passes through the wider gap. For this reason, the wire 321 never interferes with the key action mechanisms 106.

Figure 9:
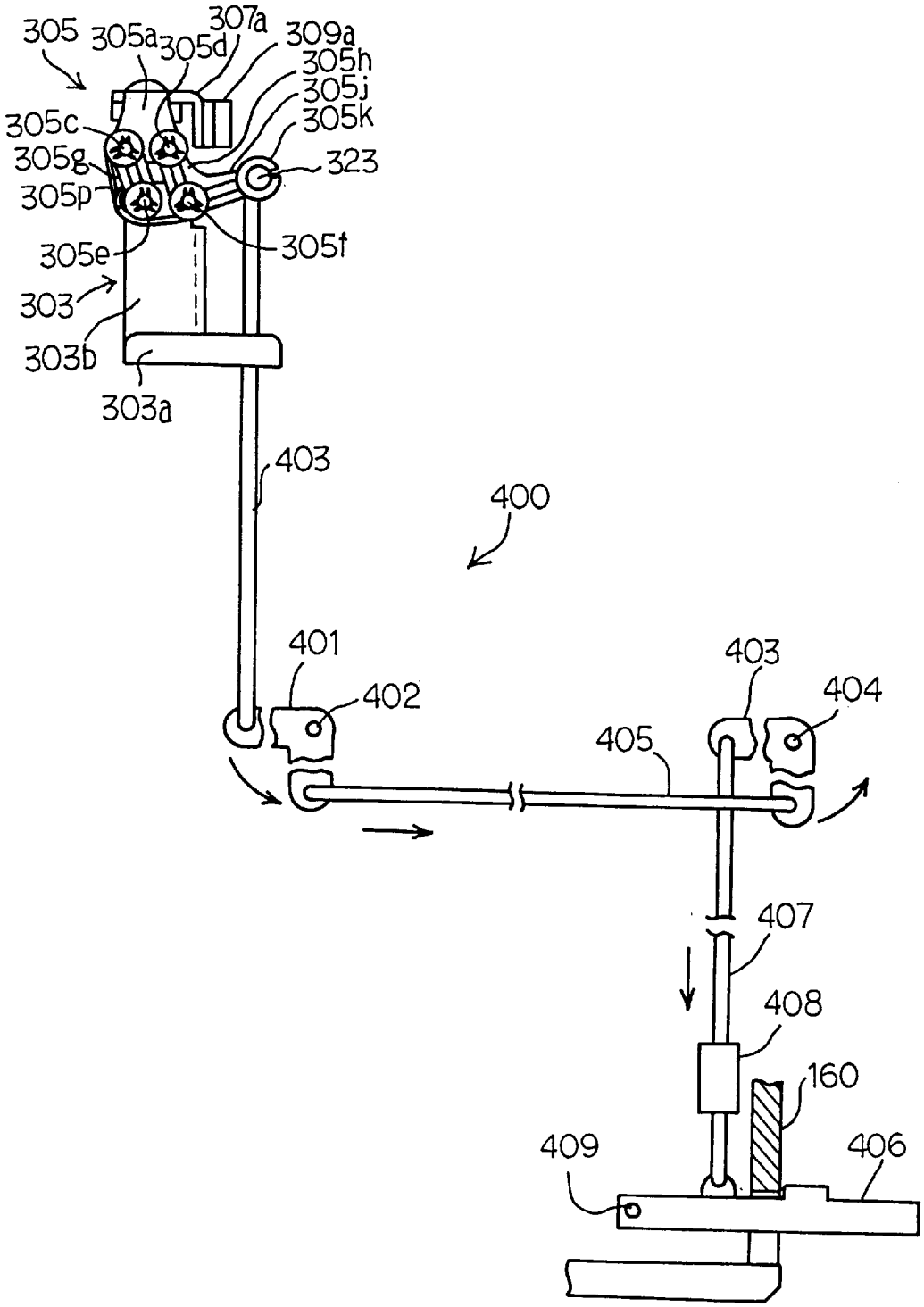
FIG. 9 is a side view showing the structure of another change-over mechanism available for the silent mechanism incorporated in the keyboard musical instrument according to the present invention.

FIG. 9 is another change-over mechanism 400 available for the hammer stopper 301. The change-over mechanism 400 is connected to the coupling unit 305 on both sides of the movable stopper 310. However, description is made on the change-over mechanism 400 linked with the coupling unit 305 on the left side of the movable stopper 310.

The change-over mechanism 400 includes the cylindrical pin member 323, an L-letter shaped plate member 401 turnably connected to the piano case 170 by means of a pin 402 and a wire 403 connected to the cylindrical pin member 323 and one end of the L-letter shaped plate member 401. The wire 403 vertically extends between the L-letter shaped plate member 401 and the cylindrical pin member 323, and transfers the angular motion of the L-letter shaped plate member 401 to the link member 305*h*.

The change-over mechanism 400 further includes an L-letter shaped plate member 403 turnably connected to the piano case 170 by means of a pin 404 and a wire 405 connected between the L-letter shaped plate members 401 and 403. The L-letter shaped plate member 403 is spaced from the L-letter shaped plate member 401 in the longitudinal direction, and the angular motion of the L-letter shaped plate member 403 is transferred through the wire 405 to the L-letter shaped plate member 401.

The change-over mechanism 400 further includes a pedal 406 projecting form the bottom sill 160, a wire 407 connected to the L-letter shaped plate member 403 and a coupling member 408 connected between the pedal 406 and the coupling member 408. The pedal 406 is turnable with respect to a pin 409. When a pianist presses down the pedal 406, the coupling member 408 changes the moment exerted on the pedal 406 to a force exerted on the wire 407 along the center axis thereof, and the wire 407 is pulled down. The wire 407 exerts moment on the L-letter-shaped plate member 403, and the L-letter shaped plate member 403 turns around the pin 404. Thus, the angular motion of the pedal 406 is transferred to the L-letter shaped plate member 403, and the angular motion of the L-shaped plate member 401 is transferred through the L-letter shaped plate member 401 to the link member 305*h* as described hereinbefore.

Though not shown in FIG. 9, the pedal 406 is associated with the ratchet mechanism. The ratchet mechanism maintains the pedal 406 at the depressed position, and releases the pedal 406 therefrom.

Behavior of Keyboard Musical Instrument

When the movable stopper 310 is changed to the free position, the keyboard musical instrument behaves as follows. The change-over mechanism 302 does not exert any moment on the link member 305*h*, and the torsion coil string 305*p* urges the link members 305*g*/305*h* to rearwardly decline. As a result, the parallelogram crank mechanism shunts the movable stopper 310 from the trajectory of the hammer shanks 124.

Assuming now that a pianism depresses the white key 104 (see FIG. 1) during playing a tune on the keyboard 101, the capstan button 116 pushes up the whippen heel 114, and the whippen 113 turns around the whippen flange 111 in the counter clockwise direction. The jack 117 also turns around the whippen flange 111 without relative rotation around the jack flange 115, and causes the hammer butt 123 to turn around the butt flange 122 in the counter clockwise direction.

Figure 10:
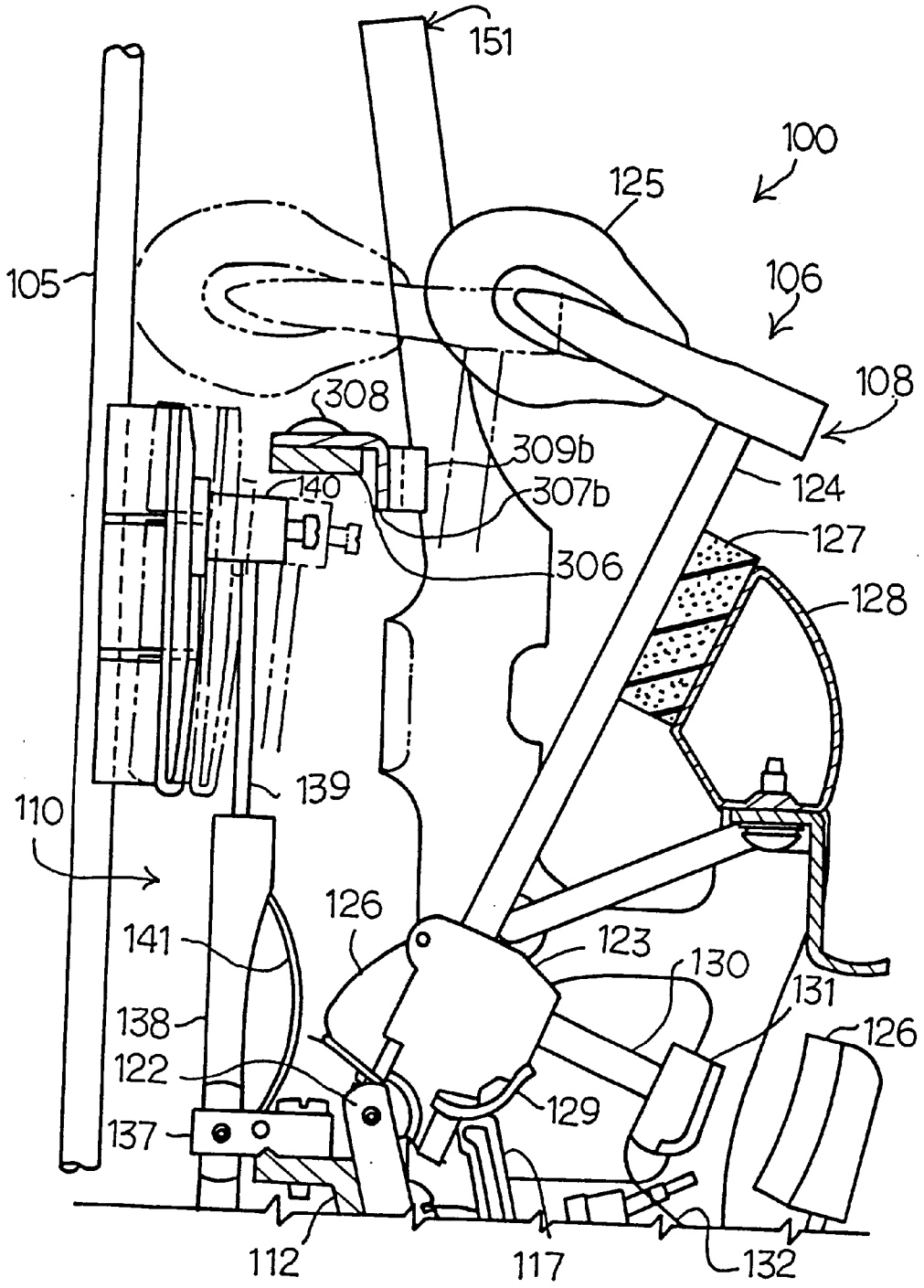
FIG. 10 is a side view showing the movable stopper in a free position.

The damper spoon 119 turns together with the whippen 113, and rearwardly declines. The damper spoon 119 pushes the damper lever 138, and spaces the damper head 140 from the set of strings 105. Thus, the set of strings becomes ready for vibration. When the damper head 140 is spaced from the set of strings 105, the damper head 140 is positioned as indicated by dots-and-dash line in FIG. 10, and is never brought into contact with the movable stopper 310.

When the tow 117*b* is brought into contact with the regulating button 135, the jack stops the rotation around the whippen flange 111, and quickly turns around the jack flange 115 against the jack spring 118. Then, the jack 117 kicks the butt skin 129, and the hammer butt 123 escapes from the jack 117. The hammer butt 123 rotates the hammer shank 124 and the hammer head 125 toward the set of strings 105, and the hammer head 125 strikes the set of strings 105 without any interruption of the hammer stopper 301 (see FIG. 10). The set of strings 105 vibrates, and generates an acoustic sound.

The hammer head 125 rebounds on the set of strings 105, and returns to the home position. The catcher 131 is brought into contact with the back check 120, and the back check 120 stops the rotation of the hammer shank 124. The jack slides into the contact position under the butt skin 129, and the hammer shank 124 returns to the contact position with the hammer rail cloth 124 after the release of the depressed white key 104. The damper head 140 is brought into contact with the set of strings 105 after the release of the depressed white key 104.

If the pianist presses down a damper pedal, the damper heads 140 are spaced from the sets of strings 105, and prolong the vibrations of the set of strings 105. The function of the damper pedal is well known to a person skilled in the art, and no further description is incorporated hereinbelow.

Figure 11:
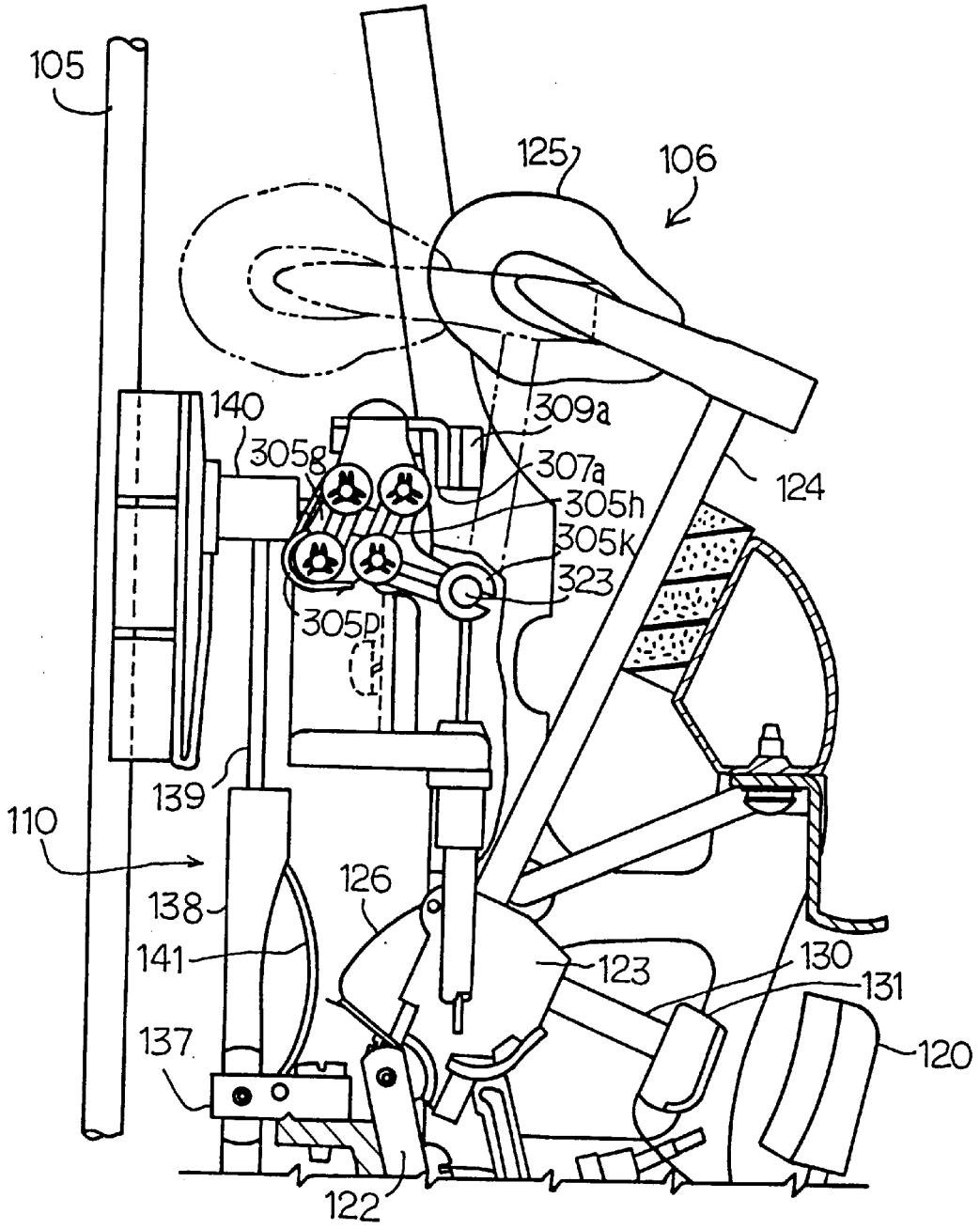
FIG. 11 is a side view showing the movable stopper in a blocking position.

When the pianist wants to play a tulle on the keyboard without the acoustic sounds, he presses down the pedal 320*a*, and the change-over mechanism 302 rotates the link members 305*g*/305*h* around the pins 305*e*/305*f* in the clockwise direction (FIGS. 6 or 9). As a result, the link members 305*g*/305*h* forwardly decline, and the parallelogram crank mechanism pushes the movable stopper 310 toward the hammer shanks 124. The hammer stopper 301 is changed from the free position to the blocking position, and the cushion members 309*a*/309*b*/309*c* enter into the trajectories of the hammer shanks 124 as shown in FIG. 11. In FIG. 11, only the hammer assembly 108, the damper assembly 107, the strings 105 and the movable stopper 310 are labeled with the references for the sake of simplicity.

In this situation, when the pianism depresses the white key 104, the capstan button 116 pushes up the whippen heel 114, and the whippen 113 turns around the whippen flange 111 in the counter clockwise direction. The jack 117 also turns around the whippet flange 111 without relative rotation around the jack flange 115, and causes the hammer butt 123 to turn around the butt flange 122 in the counter clockwise direction.

The damper spoon 119 turns together with the whippen 113, and rearwardly declines. The damper spoon 119 pushes the damper lever 138, and spaces the damper head 140 from the set of strings 105. Thus, the set of strings becomes ready for vibration. When the damper head 140 is spaced from the set of strings 105, the damper head 140 is never brought into contact with the movable stopper 310.

When the tow 117*b* is brought into contact with the regulating button 135, the jack stops the rotation around the whippen flange 111, and quickly turns around the jack flange 115 against the jack spring 118. Then, the jack 117 kicks the butt skin 129, and the hammer butt 123 escapes from the jack 117. The hammer butt 123 rotates the hammer shank 124 and the hammer head 125 toward the set of strings 105. However, the hammer shank 124 rebounds on the cushion member 309*a*/309*b*/309*c* before the strike against the set of strings 105, and the hammer head 125 does not strike the set of strings 105.

The key sensor 205 detects the current position of the depressed white key 104 along the trajectory from the rest position to the end position, and reports the key position through the key position signal KP to the controller 202. The controller 202 determines the timing to generate an electronic sound, and electronically generates the audio signal AD. The audio signal AD is supplied to the headphone 203 and generates the electronic sound corresponding to the acoustic sound.

The hammer head 125 returns to the home position. The catcher 131 is brought into contact with the back check 120, and the back check 120 stops the rotation of the hammer shank 124. The jack slides into the contact position under the butt skin 129, and the hammer shank 124 returns to the contact position with the hammer rail cloth 124 after the release of the depressed white key 104. The damper head 140 is brought into contact with the set of strings 105 after the release of the depressed white key 104.

The key sensor 205 reports the current key position on the trajectory from the end position to the rest position through the key position signal KP to the controller 202, and terminates the generation of the audio signal AD on the way to the rest position.

As will be appreciated from the foregoing description, the parallelogram crank mechanism according to the present invention changes the movable stopper 310 between the free position and the blocking position. The parallelogram crank mechanism causes the movable stopper 310 to occupy space narrower than the space required by the prior art hammer stopper, because the movable stopper 310 is projected into and retracted from the trajectory of the hammer shank 124. Even if the component parts of the key action mechanism 106 require large margin for assembly, the silent mechanism is installed inside the piano case 170 without interference therewith.

Moreover, the parallelogram crank mechanism does not require a guide, and the silent mechanism 300 is smaller in the number of component parts than the prior art silent mechanism. This results in reduction of production cost.

The driving mechanism 302 or 400 may be connected to the movable stopper 310 instead of the link members 305*g*/305*h*. For this reason, the manufacturer has wide selection for the space where the change-over mechanism 302/400 is installed.

In the above described embodiments, the wire 321/403 changes the angular position of the connecting plate 305*j* across the perpendicular position with respect to the wire 321/403, and the pulling force effectively produces the moment around the pin 305*f*. The cylindrical pin member 323 is integrated with the wire 321/403, and the change-over mechanism 302/400 is easily assembled with the coupling unit 305.

The upright piano 100 has the hammer assemblies 108 and the damper assemblies 110 arranged in the lateral direction. If the link members 305*g*/305*h* turn on a virtual surface where the axis of the stopper rail 306 extends, the link members 305*g*/305*h* or the stopper rail 306 is liable interfere with the action mechanisms 306. The link members 305*g*/305*h* according to the present invention turns on virtual surfaces perpendicular to the axis of the stopper rail 306, and the manufacturer easily arranges the parallelogram crank mechanisms and the change-over mechanism 302/400 in the narrow space inside the piano case 170.

The keyboard musical instrument shown in FIGS. 2 to 7 has the pair parallelogram crank mechanisms provided on both sides of the movable stopper 310 and, accordingly, the array of the hammer assemblies 108, and the change-over mechanism 302/400 is connected to those pair of parallelogram crank mechanisms. For this reason, only the movable stopper 310 occupies the narrow space between the hammer shanks 124 and the sets of strings 105, and the parallelogram crank mechanisms do not interfere with the key action mechanisms 106.

In the embodiment shown in FIG. 8, the parallelogram crank mechanisms are increased, and the increased parallelogram crank mechanisms allow the movable stopper 310 to lightly turn. The change-over mechanism 302 is connected to the coupling unit 305 at the intermediate position, and allows the movable stopper 310 to smoothly turn. The wire connected to the coupling unit 305 at the intermediate position passes through the gap between the reinforcing rib and the rear end portion of the keys 103/104, and the change-over mechanism 302 does not interfere with the key action mechanisms 106.

The change-over mechanism 302/400 and the torsion coil spring 305*p* determines the angular position of tile link members 305*g*/305*h*. The torsion coil spring 305*p* is wound on the bobbins of the link members 305*g*/305*h*, and does not require additional space. The torsion coil spring 305*p* easily is assembled with the link members 305*g*/305*h*.

Although particular embodiments of the present invention have been shown and described, it will be obvious to those skilled in the art that various changes and modifications may be made without departing from the spirit and scope of the present invention.

The torsion coil spring may be engaged with different bobbins. The pedal sub-mechanism 320 may be connected through three flexible wires to the three coupling units 305.

The change-over mechanism may be connected to one of the parallelogram crank mechanisms.

The center stay 310*b*, the bracket 310*a* and the coupling unit 305 connected therebetween may be deleted from the silent mechanism 300 for decreasing the component parts. The coupling units 305 may be provided outside the array of the key action mechanisms 106.

The silent mechanism 300 may be installed in an acoustic piano after the delivery to user.

The change-over mechanism may be manipulated by the hand of a pianist or implemented by a solenoid-operated actuator or an electric motor.

The acoustic piano 100 may be a grand piano.

What is claimed is:

1. A keyboard musical instrument comprising an acoustic piano including a keyboard having a plurality of keys turnable with respect to a stationary board member, a plurality of string means vibratory for generating acoustic sounds, and a plurality of key action mechanisms respectively linked with said plurality of keys and having respective hammers each driven for rotation along a trajectory so as to strike associated one of said plurality of string means when associated one of said plurality of keys is depressed, an electronic sound generating system monitoring said plurality of keys and generating an electronic sounds when one of said plurality of keys is depressed, and a silent mechanism including a movable stopper changed between a free position and a blocking position, said movable stopper in said free position being out of said trajectory of each of said hammers so as to allow said each of said hammers to strike associated one of said plurality of string means, said movable stopper in said blocking position being positioned in said trajectory of said each of said hammers so as to interrupt said each of said hammers before a strike against associated one of said plurality of string means, a stationary member stationary with respect to said stationary board member, two link members having respective first ends turnably connected to said movable stopper and respective second ends turnably connected to said stationary member so as to form a parallelogram crank mechanism together with said stationary member and said movable stopper, and a driving means connected to at least one of said two link members and said movable stopper and changing an angular position of said two link members so as to change said movable stopper between said free position and said blocking position.

2. The keyboard musical instrument as set forth in claim 1, in which said movable stopper is elongated in a lateral direction where said plurality of key action mechanisms are arranged, and said two link members turn on a virtual plane substantially normal with respect to said lateral direction.

3. The keyboard musical instrument as set forth in claim 2, in which said driving means includes a manipulator manipulated by a player, an engaging member projecting from one of said two link members and a linkage means connected between said manipulator and said engaging member for exerting moment on said one of said two link members.

4. The keyboard musical instrument as set forth in claim 3, in which said manipulator is a pedal pressed by a foot of said player.

5. The keyboard musical instrument as set forth in claim 3, in which said driving means further a resilient member engaged with said two link members and urging said two link members to a first angular position where said movable stopper is in said free position.

6. The keyboard musical instrument as set forth in claim 5, in which said resilient member is a torsion coil member having two arms respectively engaged with said two link members.

7. The keyboard musical instrument as set forth in claim 1, in which said movable stopper is elongated in a lateral direction where said plurality of key action mechanisms are arranged, and is turnably supported at both end portions thereof, one of which is connected to said parallelogram crank mechanism, said silent mechanism further including another parallelogram crank mechanism similar in structure to said parallelogram link mechanism and connected to the other of said both end portions.

8. The keyboard musical instrument as set forth in claim 1, in which said movable stopper is elongated in a lateral direction where said plurality of key action mechanisms are arranged, and is turnably supported at both end portions thereof and an intermediate portion thereof, one of said both end portions is connected to said parallelogram crank mechanism, said silent mechanism further including another parallelogram crank mechanism similar in structure to said parallelogram link mechanism and connected to said intermediate portion.

9. The keyboard musical instrument as set forth in claim 1 in which each of said plurality of key action mechanisms further has a jack from which said hammer escapes on the way to an end position of associated one of said plurality of keys, and said movable stopper in said blocking position causes each of said hammers to rebound thereon after the escape from said jack.

10. The keyboard musical instrument as set forth in claim 9, in which said movable stopper is projected into a trajectory of each of said hammers when said driving means changes said movable stopper from said free position to said blocking position, and is retracted from said trajectory when said driving means changes said movable stopper from said blocking position to said free position.

11. The keyboard musical instrument as set forth in claim 1, in which said movable stopper is elongated in a lateral direction where said plurality of key action mechanisms are arranged, and has a stopper rail and a plurality of cushion structures attached to said stopper rail at intervals.

12. The keyboard musical instrument as set forth in claim 11, in which said stopper rail is bent so as to regulate said cushion structures to respective height appropriate for receiving hammer shanks of said hammers.

* * * * *